US008833811B2

(12) United States Patent
Ishikawa et al.

(10) Patent No.: US 8,833,811 B2
(45) **Date of Patent: *Sep. 16, 2014**

(54) TRUNK LOCKING SYSTEM

(75) Inventors: Tetsuya Ishikawa, Toyokawa (JP); Kazuya Yokoyama, Toyota (JP)

(73) Assignee: Shiroki Corporation, Kanagawa (JP)

( * ) Notice: Subject to any disclaimer, the term of this patent is extended or adjusted under 35 U.S.C. 154(b) by 248 days.

This patent is subject to a terminal disclaimer.

(21) Appl. No.: 13/197,094

(22) Filed: Aug. 3, 2011

(65) Prior Publication Data

US 2012/0032457 A1 Feb. 9, 2012

(30) Foreign Application Priority Data

Aug. 4, 2010 (JP) ..... 2010-175063

(51) Int. Cl.

| | |
|---|---|
| ***E05B 3/00*** | (2006.01) |
| ***E05B 17/10*** | (2006.01) |
| ***E05B 83/26*** | (2014.01) |
| *E05B 65/10* | (2006.01) |

(52) U.S. Cl.

CPC ..... *E05B 17/106* (2013.01); *E05B 83/26* (2013.01); *Y10S 292/42* (2013.01); *Y10S 292/65* (2013.01)

USPC ..... 292/336.3; 292/DIG. 42; 292/DIG. 65

(58) Field of Classification Search

USPC ..... 292/336.3, DIG. 38, DIG. 42, DIG. 65; 264/279.1

See application file for complete search history.

(56) References Cited

U.S. PATENT DOCUMENTS

| | | | | | |
|---|---|---|---|---|---|
| 805,470 | A | * | 11/1905 | Kempshall | 442/232 |
| 2,425,611 | A | * | 8/1947 | Frost et al. | 292/347 |
| 3,604,741 | A | * | 9/1971 | Steere, Jr. | 292/347 |
| 3,962,399 | A | * | 6/1976 | Shepherd et al. | 264/261 |
| 5,290,063 | A | * | 3/1994 | Lenhart | 280/821 |
| 5,735,511 | A | * | 4/1998 | Stocker et al. | 267/140.13 |
| 6,209,933 | B1 | * | 4/2001 | Ang et al. | 292/336.3 |
| 6,349,984 | B1 | * | 2/2002 | Marrazzo et al. | 292/336.3 |
| 6,369,395 | B1 | * | 4/2002 | Roessler | 250/462.1 |
| 6,394,511 | B1 | * | 5/2002 | Lam et al. | 292/336.3 |
| 6,550,103 | B2 | * | 4/2003 | Koops et al. | 16/412 |
| 6,568,719 | B2 | * | 5/2003 | Buscella | 292/85 |
| 6,929,294 | B2 | * | 8/2005 | Byrla et al. | 292/336.3 |
| 6,972,106 | B2 | * | 12/2005 | Huber et al. | 264/243 |

(Continued)

FOREIGN PATENT DOCUMENTS

| | | | |
|---|---|---|---|
| JP | 2000-073638 | A | 3/2000 |
| JP | 2001-182400 | A | 7/2001 |
| JP | 2007-177498 | A | 7/2007 |
| JP | U-3137425 | U | 10/2007 |

*Primary Examiner* — Carlos Lugo

(74) *Attorney, Agent, or Firm* — Millen, White, Zelano, Branigan, P.C.

(57) ABSTRACT

A trunk locking system provided with an emergency trunk release handle inside a trunk, a locking mechanism of the trunk locking system being unlocked by operating the emergency trunk release handle, wherein the emergency trunk release handle includes a handle body made of a luminous resin material containing a luminous material, and a locking-mechanism interconnecting member made of a non-luminous resin material. One of the handle body and the locking-mechanism interconnecting member is molded with the other of the handle body and the locking-mechanism interconnecting member to be joined thereto with at least a part of the other of the handle body and the locking-mechanism interconnecting member embedded in the one of the handle body and the locking-mechanism interconnecting member.

10 Claims, 8 Drawing Sheets

(56) References Cited

U.S. PATENT DOCUMENTS

| | | | | |
|---|---|---|---|---|
| 7,029,138 | B2 * | 4/2006 | Tibbenham et al. | 362/84 |
| 7,192,066 | B2 * | 3/2007 | Ilea et al. | 292/201 |
| 7,316,309 | B2 * | 1/2008 | Streich et al. | 206/1.5 |
| 7,523,970 | B2 * | 4/2009 | Konchan | 292/347 |
| 8,317,237 | B1 * | 11/2012 | Fannon et al. | 292/336.3 |
| 2005/0099021 | A1 * | 5/2005 | Jinzu et al. | 292/336.3 |
| 2010/0180400 | A1 * | 7/2010 | Pell | 16/110.1 |
| 2012/0032456 | A1 * | 2/2012 | Ishikawa et al. | 292/336.3 |

* cited by examiner

TRUNK LOCKING SYSTEM

BACKGROUND OF THE INVENTION

1. Field of the Invention

The present invention relates to a trunk locking system which controls the opening and closing of a vehicle trunk, and in particular relates to a trunk locking system which releases a vehicle trunk lock by operating an emergency trunk release handle that is installed inside a vehicle trunk.

2. Description of Related Art

This type of trunk locking system is constructed to be capable of opening a trunk door of a vehicle from the inside of the vehicle trunk cavity by manually pulling on an emergency trunk release handle installed inside the vehicle. The emergency trunk release handle that is used in this way is made of a synthetic resin containing a luminous material (a luminous resin material that glows in the dark) so that a person (especially a child) who is trapped in a vehicle trunk cavity can visually recognize the emergency trunk release handle in the dark trunk cavity, and it has been conventionally the case that the emergency trunk release handle is provided on the surface thereof with an icon such as a pictogram or a ideograms representing the usage (function) of the handle (see U.S. Pat. No. 7,029,138 B2).

Conventional emergency trunk release handles such as disclosed in the aforementioned U.S. Pat. No. 7,029,138 B2 have been made simply of a luminous resin material (single material), and the portion of the emergency trunk release handle which is connected to a locking mechanism (e.g., a lock release lever) needs to have a sophisticated shape for connecting to the locking mechanism. However, the mixing of a luminous material into a resin base material impairs its strength, and the aforementioned sophisticated shape also impairs the strength of the handle. Moreover, a luminous resin material is expensive, so that a large-sized emergency trunk release handle made of a single material (luminous resin material) becomes a cause of an increase in the cost of production.

SUMMARY OF THE INVENTION

The present invention has been devised in view of the above described problem in prior art and provides a trunk locking system provided with an emergency trunk release handle, wherein the emergency trunk release handle requires a small amount of a luminous resin material.

The present invention has been made based on an idea that the emergency trunk release handle is made of a luminous resin material and a non-luminous resin material which is lower in cost and greater in strength than the luminous resin material.

According to an aspect of the present invention, a trunk locking system provided with an emergency trunk release handle inside a trunk is provided, a locking mechanism of the trunk locking system being unlocked by operating the emergency trunk release handle, wherein the emergency trunk release handle includes a handle body made of a luminous resin material containing a luminous material, and a locking-mechanism interconnecting member made of a non-luminous resin material. One of the handle body and the locking-mechanism interconnecting member is molded with the other of the handle body and the locking-mechanism interconnecting member to be joined thereto with at least a part of the other of the handle body and the locking-mechanism interconnecting member embedded in the one of the handle body and the locking-mechanism interconnecting member.

It is desirable for the part of the other of the handle body and the locking-mechanism interconnecting member, which is embedded in the one of the handle body and the locking-mechanism interconnecting member, to include an anchor-shaped portion, a sectional area of which increases in a direction of embedding of the part of the other of the handle body and the locking-mechanism interconnecting member in the one of the handle body and the locking-mechanism interconnecting member.

It is desirable for at least one coupling through-hole to be formed through the part of the other of the handle body and the locking-mechanism interconnecting member, which is embedded in the one of the handle body and the locking-mechanism interconnecting member.

In regard to the luminous resin material, an ABS resin mixed with a luminous material such as Luminova (a trademark and a product of NEMOTO & CO., LTD) can be used. In addition, for instance, nylon or PP (polypropylene) can be used as the non-luminous resin material.

Additionally, in the case where the non-luminous resin material is molded into an icon-shaped element, it is desirable that the icon-shaped element be made of a black-colored resin material that displays a great contrast difference between the luminous resin material and the non-luminous resin material.

It is desirable for the part of the locking-mechanism interconnecting member which is embedded in the handle body to include at least one icon-shaped element that is integrally formed with the part of the locking-mechanism interconnecting member, and for the handle body to be molded with the part of the locking-mechanism interconnecting member with both end faces of the icon-shaped element exposed from a surface of the handle body.

It is desirable for the handle body and the locking-mechanism interconnecting member to be joined to each other with an end of the locking-mechanism interconnecting member embedded in an end of the handle body.

It is desirable for the handle body and the locking-mechanism interconnecting member to be joined to each other with an end of the handle body embedded in an end of the locking-mechanism interconnecting member.

It is desirable for the locking-mechanism interconnecting member to be directly connected to the locking mechanism.

It is desirable for the locking-mechanism interconnecting member to be connected to the locking mechanism via a connecting wire.

In an embodiment, a trunk locking system is provided with an emergency trunk release handle inside a trunk, a locking mechanism of the trunk locking system being unlocked by pulling on the emergency trunk release handle, wherein the emergency trunk release handle includes a handle body made of a luminous resin material, and a connecting portion made of a non-luminous resin material via which the handle body and the locking mechanism are connected to each other. One of the handle body and the connecting portion is molded with the other of the handle body and the connecting portion to be joined thereto with at least a part of the other of the handle body and the connecting portion embedded in the one of the handle body and the connecting portion.

According to the present invention, a trunk locking system which is equipped with an emergency trunk release handle containing a small amount of luminous material and is not inferior in strength is obtained.

The present disclosure relates to subject matter contained in Japanese Patent Application No. 2010-175063 (filed on Aug. 4, 2010), which is expressly incorporated herein by reference in its entirety.

BRIEF DESCRIPTION OF THE DRAWINGS

The present invention will be discussed below in detail with reference to the accompanying drawings, in which.

DESCRIPTION OF THE EMBODIMENTS

Figure 8:
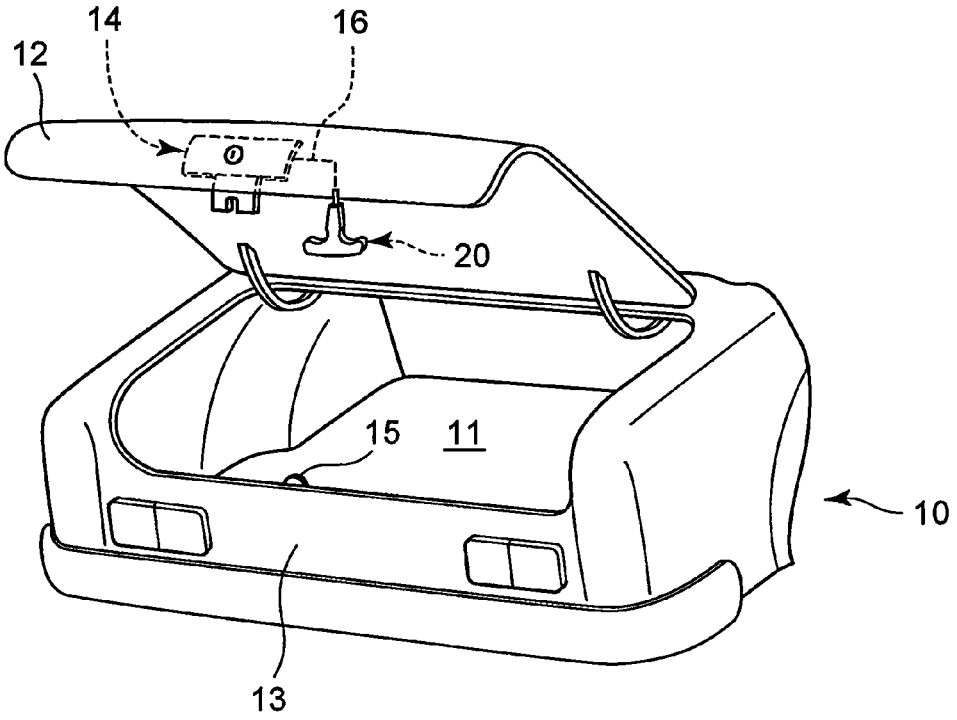
FIG. 8 is a perspective view of a rear part of a vehicle around the trunk (trunk lid) to which a trunk locking system equipped with an emergency trunk release handle according to the present invention is installed.

FIG. 8 shows a rear part of a vehicle 10 around a trunk thereof to which a trunk locking system equipped with an emergency trunk release handle (internal trunk release lever) according to the present invention is installed. The vehicle 10 is provided in the rear thereof with a trunk cavity 11 and a trunk lid 12 for opening and closing the trunk cavity 11. The trunk locking system is provided with a locking mechanism 14, a striker 15 and an emergency trunk release handle 20. The locking mechanism 14 and the striker 15 that are for locking the trunk lid 12 in the lock position are fixed to the trunk lid 12 and a vehicle body 13, respectively.

The emergency trunk release handle 20 is connected to the locking mechanism 14 via a connecting wire 16. The emergency trunk release handle 20 is held by (or suspended from) an inner surface of the trunk lid 12. In case of accidental shutting of the trunk lid 12 with a person in the trunk cavity 11, this person trapped in the trunk cavity 11 can unlock the locking mechanism 14 to open the trunk lid 12 from the inside of the trunk cavity 11 by manually pulling on the emergency trunk release handle 20 in the trunk cavity 11. The locking mechanism 14 can be unlocked by a normal lock release operation; however, a normal lock release system is not shown in the drawings.

Each embodiment of the trunk locking system which will be discussed below is characterized by the emergency trunk release handle 20 thereof that is used in the above described manner, and FIGS. 1 through 4 shows a first embodiment of the trunk locking system. The emergency trunk release handle 20 includes a handle body 20H and a locking-mechanism interconnecting member 20C joined to the handle body 20H. The handle body 20H is made of a luminous resin material (e.g., an ABS resin) containing a luminous material (e.g., Luminova (a trademark and a product of NEMOTO&CO., LTD) so that one can see the handle body 20H in the dark. The locking-mechanism interconnecting member 20C is made of a non-luminous resin material (e.g., nylon) which is lower in price and higher in strength than a luminous resin material.

The handle body 20H is formed into a macroscopically T-shaped plate so as to be held by the operator's fingers, and icon-shaped through holes 21 that visually indicate the function and operating procedure of the emergency trunk release handle 20 are formed through the handle body 20H Icon-shaped elements 22 serving as pictorial representations which are made of a non-luminous resin (e,g, a black-colored nylon) are molded and embedded into the icon-shaped through holes 21. The inner periphery of each icon-shaped through hole 21 partly projects inwardly to form a retaining projection 23 (see FIG. 3), while the outer periphery of each icon-shaped element 22 partly projects outwardly to form a retaining recess 24 to correspond to the retaining projection 23 in the associated icon-shaped through hole 21.

The handle body 20H is provided, at an end thereof on the locking-mechanism interconnecting member 20C side, with an anchor-shaped portion 25, the sectional area of which firstly increases and subsequently decreases in the direction toward the locking-mechanism interconnecting member 20C. A coupling through hole 26 is formed through the anchor-shaped portion 25. The locking-mechanism interconnecting member 20C is double-molded in a different color (material) from the handle body 20H around the anchor-shaped portion 25 and the coupling through hole 26 of the handle body 20H (the locking-mechanism interconnecting member 20C is molded integrally with the handle body 20H so that the anchor-shaped portion 25 is embedded in the end (the upper end with respect to FIG. 1) of the locking-mechanism interconnecting member 20C which is fixed to the handle body 20H). The locking-mechanism interconnecting member 20C is provided on the handle body 20H with a columnar portion 27, and is further provided with an extension portion 28 which is connected to the columnar portion 27 to be continuous therefrom. A wire connecting hole 29 for connecting with the connecting wire 16 is formed through the extension portion 28. It is desirable that the locking-mechanism interconnecting member 20C and the icon-shaped elements 22 be double-molded simultaneously with the handle body 20H molded in advance.

The above described formation of the icon-shaped through holes 21 in the handle body 20H makes it possible to achieve a reduction in amount of a high-cost luminous resin material to be used. In addition, the above described molding and embedding of the non-luminous icon-shaped elements 22 in the icon-shaped through holes 21 makes it possible to enhance the visibility of the icon-shaped elements 22 regardless of the orientation of the emergency trunk release handle 20. More specifically, assuming the situation that the emergency trunk release handle 20 (the handle body 20H) is seen from the direction of the arrow A shown in FIG. 3 and that non-luminous elements such as the non-luminous icon-shaped elements 22 are not embedded in the icon-shaped through holes 21, the edges of each icon-shaped through hole 21 at both ends thereof cannot be visually recognized clearly and therefore the visibility of the icon-shaped elements 22 deteriorates because the handle body 20H that has the icon-shaped through holes 21 is entirely made of a luminous resin material. In contrast to this, if the non-luminous icon-shaped elements 22 are respectively positioned (embedded) in the icon-shaped through holes 21, the icon-shaped elements 22 can be visually recognized clearly as non-luminous portions positioned in the luminous resin material (the handle body 20H) regardless of the direction in which the emergency trunk release handle 20 (the handle body 20H) is seen.

The locking-mechanism interconnecting member 20C is made of a resin material (e.g., nylon) which is lower in cost than and superior in strength to the luminous resin material of the handle body 20H; moreover, the locking-mechanism interconnecting member 20C is formed into a shape having a sufficient strength. In addition, the combination of the locking-mechanism interconnecting member 20C and the handle body 20H ensures a sufficient strength because the locking-mechanism interconnecting member 20C and the handle body 20H are molded together with the anchor-shaped portion 25 and the coupling through hole 26 that are formed on the handle body 20H embedded in the locking-mechanism interconnecting member 20C.

Figure 1:
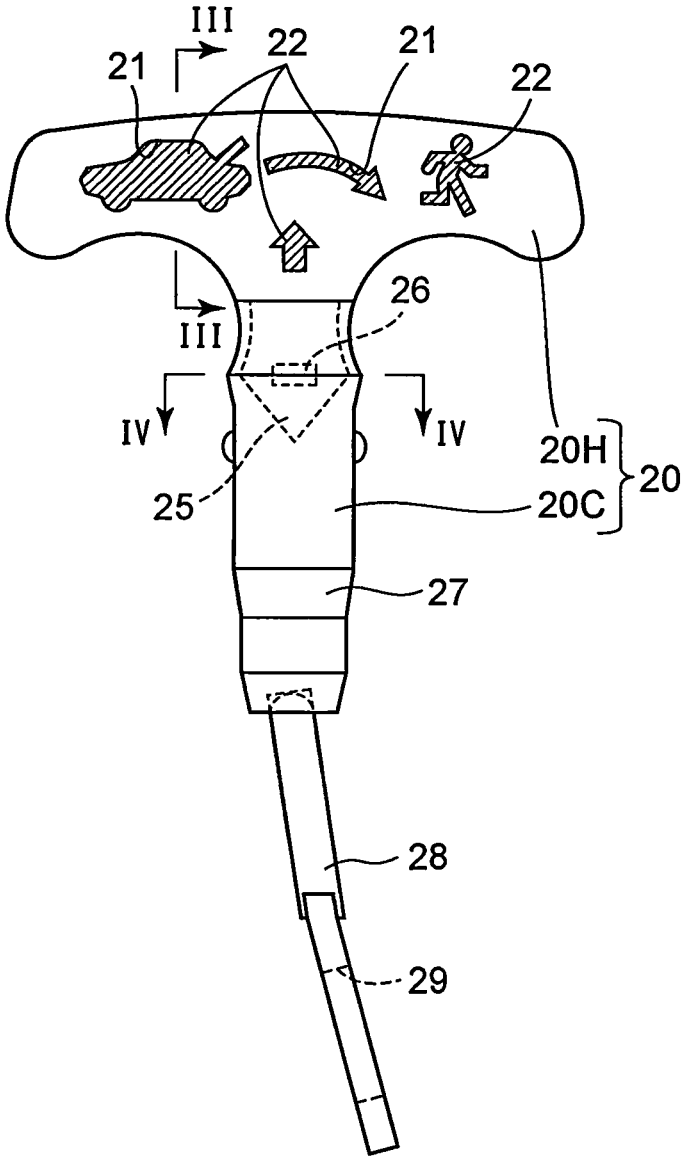
FIG. 1 is a front elevational view of a main part of an embodiment of a trunk locking system equipped with an emergency trunk release handle according to the present invention.
Figure 2:
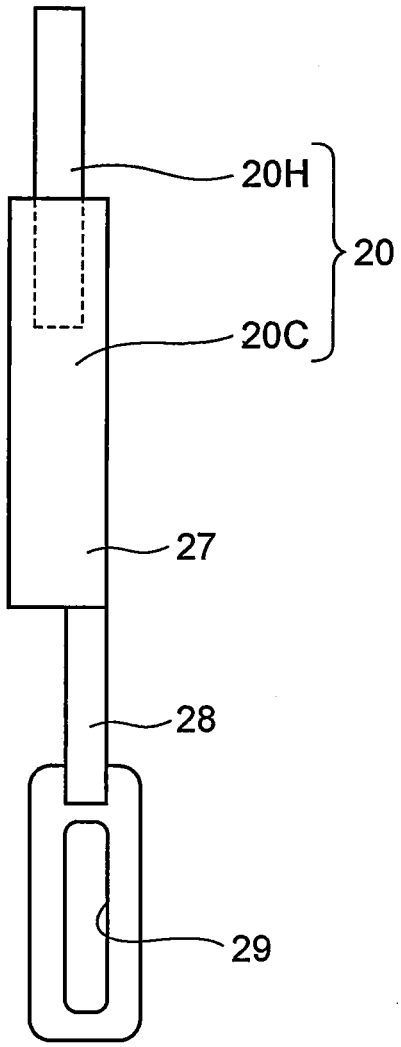
FIG. 2 is a side elevational view of the components shown in FIG. 1.
Figure 3:
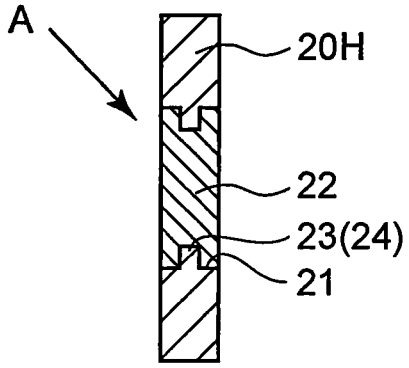
FIG. 3 is a cross sectional view taken along the III-III line shown in FIG. 1.
Figure 4:
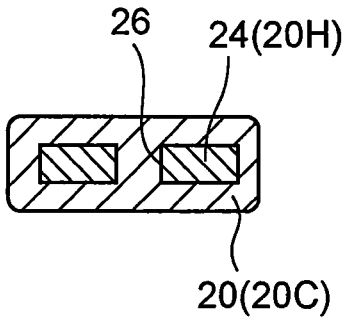
FIG. 4 is a cross sectional view taken along the IV-IV line shown in FIG. 1
Figure 5:
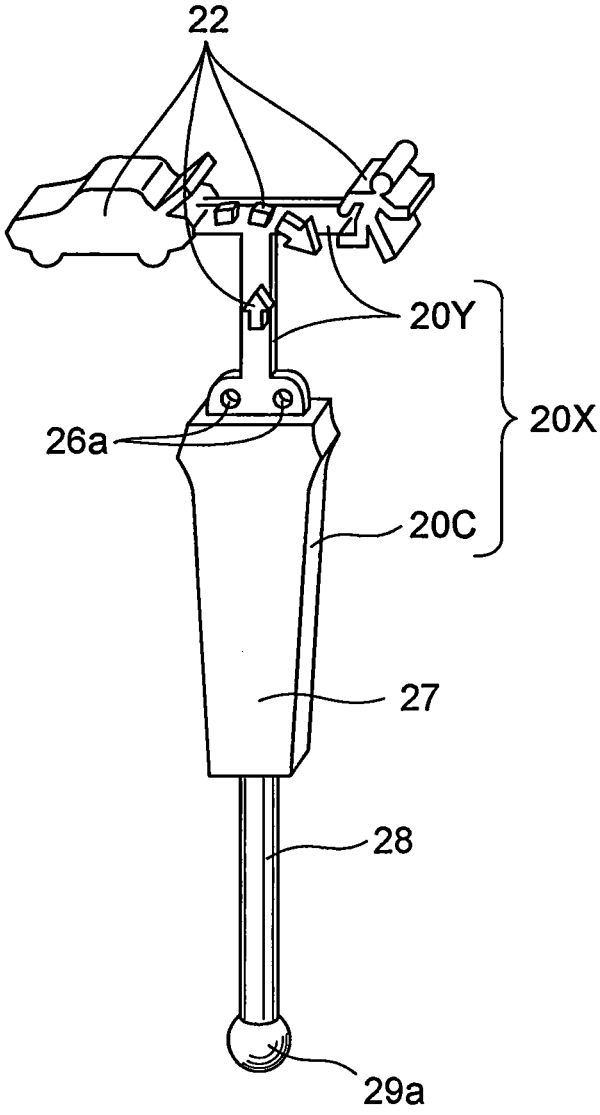
FIG. 5 is a perspective view of a main part of another embodiment of the trunk locking system equipped with an emergency trunk release handle according to the present invention.
Figure 6:
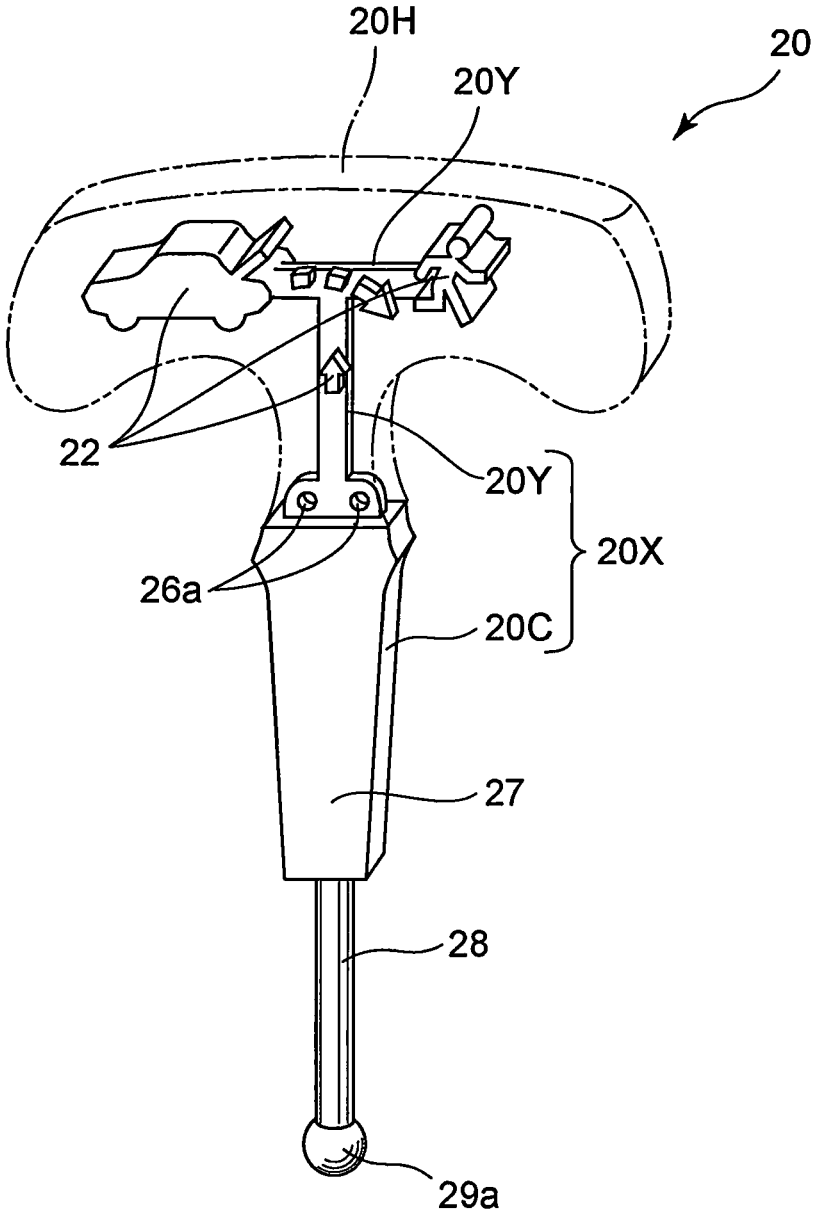
FIG. 6 is a perspective view of the components shown in FIG. 5 in a different state.
Figure 7:
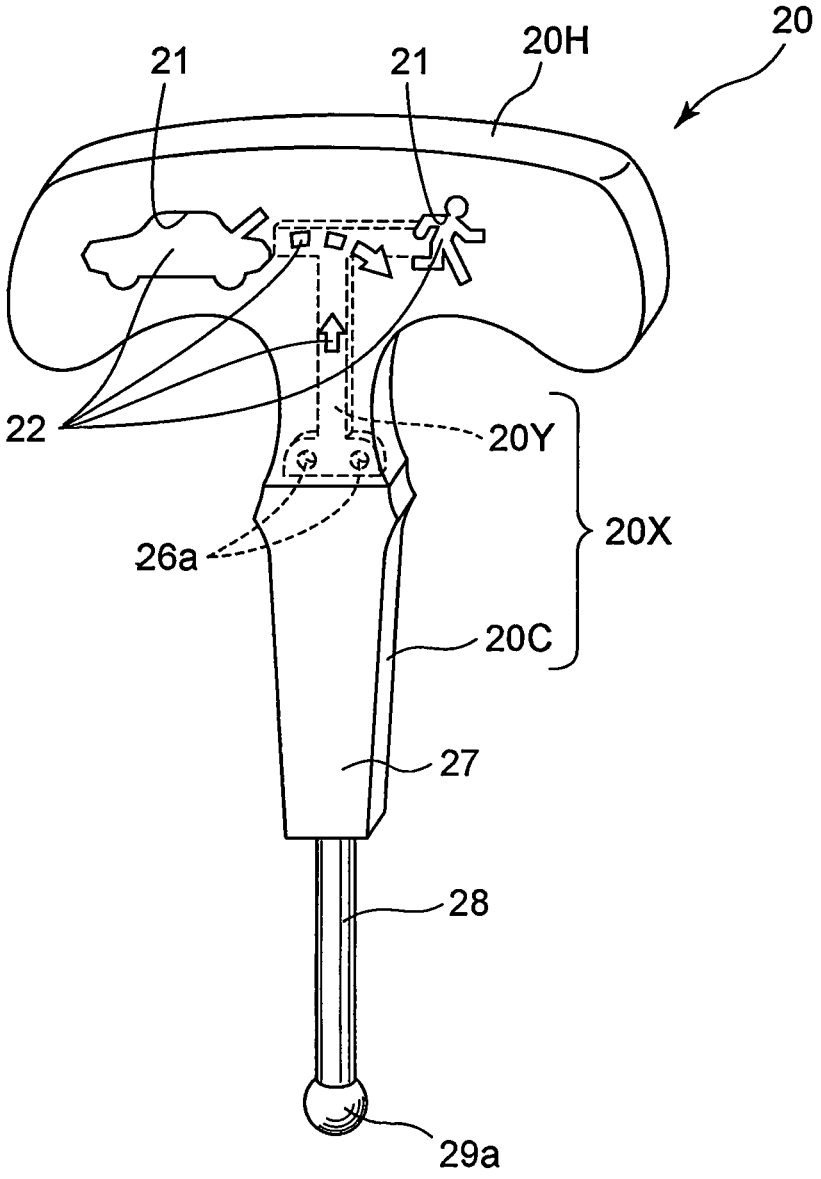
FIG. 7 is a perspective view of the components shown in FIG. 5 in another state.
Figure 9:
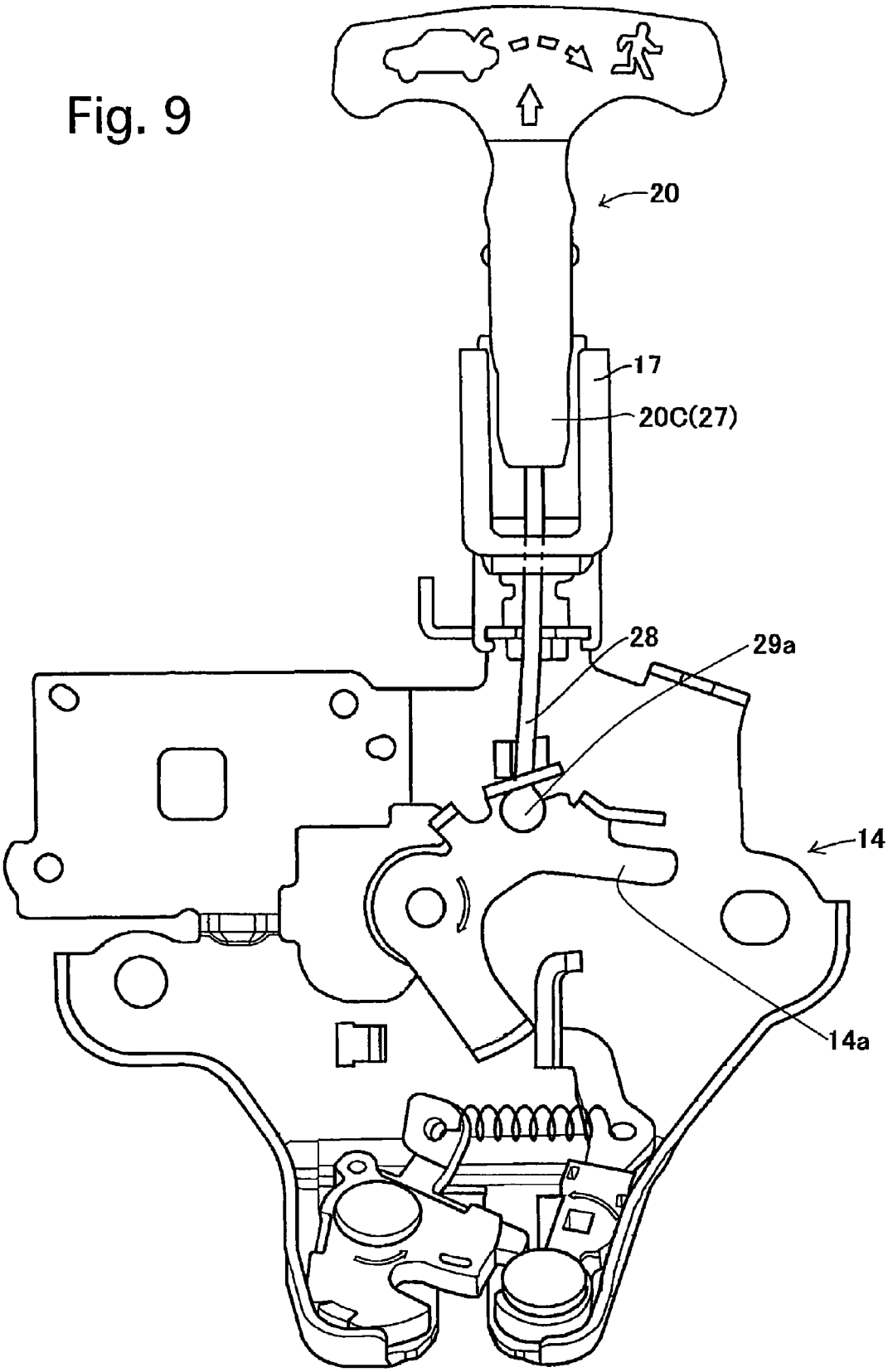
FIG. 9 is a front elevational view of another embodiment of the trunk locking system equipped with an emergency trunk release handle according to the present invention.

FIGS. 5 through 7 show another embodiment of the emergency trunk release handle 20 according to the present invention. In this embodiment, as shown in FIG. 5, the icon-shaped elements 22 and the locking-mechanism interconnecting member 20C are integrally molded in advance from a non-luminous resin material (e.g., nylon) to be formed as an icon-embedded locking-mechanism interconnecting member (locking-mechanism interconnecting member) 20X. More specifically, the icon-embedded locking-mechanism interconnecting member 20X is provided with a thin-walled T-shaped connecting portion 20Y, from which the icon-shaped elements 22 protrude at both sides. The T-shaped connecting portion 20Y is integrally formed with the locking-mechanism interconnecting member 20C. Two coupling reinforcing holes (coupling through-holes) 26*a* are formed through an end of the T-shaped connecting portion 20Y at the locking-mechanism interconnecting member 20C side. Instead of the wire connecting hole 29 shown in FIGS. 1 and 2, the extension portion 28 of the icon-embedded locking-mechanism interconnecting member 20X is provided, at the opposite end thereof from the locking-mechanism interconnecting member 20C (the lower end of the extension portion 28 with respect to FIG. 5), with a locking mechanism coupling sphere 29*a* which is integrally molded with the extension portion 28. As shown in FIG. 9, the locking mechanism coupling sphere 29*a* is directly hitched to a lock release lever (rigid lever) 14*a* (without via a flexible connecting wire).

The handle body 20H and the icon-embedded locking-mechanism interconnecting member 20X are double-molded (the handle body 20H is molded with the T-shaped connecting portion 20Y embedded in the handle body 20H). Namely, the handle body 20H is molded around both sides of the T-shaped connecting portion 20Y (including the two coupling reinforcing holes 26*a*) so as to have the same thickness as the icon-shaped elements 22 (see FIGS. 6 and 7). Accordingly, the icon-shaped elements 22 are identical in thickness to the handle body 20H, and both end faces of each icon-shaped element 22 in the direction of thickness thereof (the direction of thickness of the handle body 20H) are exposed from the surface of the handle body 20H, and therefore, the icon-shaped elements 22 having the same (inverted) shape can be visually recognized from either side of the handle body 20H. The handle body 20H and the icon-embedded locking-mechanism interconnecting member 20X are firmly and securely joined to each other due to the difference in thickness between each icon-shaped element 22 and the T-shaped connecting portion 20Y and the engagement of the handle body 20H with the two coupling reinforcing holes 26*a*.

In the embodiment shown in FIGS. 5 through 7, the icon-shaped through holes 21 cannot be seen before the handle body 20H is molded because the handle body 20H is molded in a different color (material) from the icon-embedded locking-mechanism interconnecting member 20X after the icon-embedded locking-mechanism interconnecting member 20X is molded. However, the icon-shaped through holes 21 that correspond to the icon-shaped elements 22 are formed through the post-molded handle body 20H. In addition, similar to the first embodiment, the effect of improving the visibility of the icon-shaped elements 22 that is produced by the existence of the icon-shaped elements 22 in the icon-shaped through holes 21 can also be obtained in the embodiment shown in FIGS. 5 through 7.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A trunk locking system provided with an emergency trunk release handle inside a trunk, a locking mechanism of said trunk locking system being unlocked by operating said emergency trunk release handle, wherein said emergency trunk release handle comprises:

a handle body made of a luminous resin material containing a luminous material; and a locking-mechanism interconnecting member made of a non-luminous resin material, wherein one of said handle body and said locking-mechanism interconnecting member is molded with the other of said handle body and said locking-mechanism interconnecting member to be joined thereto with at least a part of said other of said handle body and said locking-mechanism interconnecting member embedded in said one of said handle body and said locking-mechanism interconnecting member, wherein at least one coupling through-hole is formed through said embedded part of said other of said handle body and said locking-mechanism interconnecting member, so that the embedded part is surrounded by a portion of said one of said handle and said locking-mechanism interconnecting member, wherein said portion surrounding the embedded part is integrally formed with said one of said handle body and said locking-mechanism interconnecting member, and connected through said at least one coupling through-hole, and wherein said part of said other of said handle body and said locking-mechanism interconnecting member, which is embedded in said one of said handle body and said locking-mechanism interconnecting member, comprises an anchor-shaped portion, a sectional area of which increases in a direction of embedding of said part of said other of said handle body and said locking-mechanism interconnecting member in said one of said handle body and said locking-mechanism interconnecting member.

2. The trunk locking system according to claim 1, wherein the part of said locking-mechanism interconnecting member which is embedded in said handle body comprises at least one icon-shaped element that is integrally formed with said part of said locking-mechanism interconnecting member, and wherein said handle body is molded with said part of said locking-mechanism interconnecting member with both end faces of said icon-shaped element exposed from a surface of said handle body.

3. The trunk locking system according to claim 1, wherein said handle body and said locking-mechanism interconnecting member are joined to each other with an end of said locking-mechanism interconnecting member embedded in an end of said handle body.

4. The trunk locking system according to claim 1, wherein said handle body and said locking-mechanism interconnecting member are joined to each other with an end of said handle body embedded in an end of said locking-mechanism interconnecting member.

5. The trunk locking system according to claim 1, wherein said locking-mechanism interconnecting member is directly connected to said locking mechanism.

6. The trunk locking system according to claim 1, wherein said locking-mechanism interconnecting member is connected to said locking mechanism via a connecting wire.

7. The trunk locking system according to claim 1, wherein the at least one coupling through-hole is formed through the at least a part of said other of said handle body and said locking-mechanism interconnecting member embedded in said one of said handle body and said locking-mechanism interconnecting member.

8. The trunk locking system according to claim 1, wherein said emergency trunk release handle is configured to operate by being manually pulled, wherein said coupling through-hole is formed at a close vicinity of a boundary between said handle body and said locking-mechanism interconnecting member, and wherein said coupling through-hole extends in a direction that intersects the manually pulling direction of said emergency trunk release handle.

9. A trunk locking system provided with an emergency trunk release handle inside a trunk, a locking mechanism of said trunk locking system being unlocked by pulling on said emergency trunk release handle, wherein said emergency trunk release handle comprises:

a handle body made of a luminous resin material; and a connecting portion made of a non-luminous resin material via which said handle body and said locking mechanism are connected to each other, and wherein one of said handle body and said connecting portion is molded with the other of said handle body and said connecting portion to be joined thereto with at least a part of said other of said handle body and said connecting portion embedded in said one of said handle body and said connecting portion, wherein at least one coupling through-hole is formed through said embedded part of said other of said handle body and said connecting portion, so that the embedded part is surrounded by a portion of said one of said handle and said connecting portion, wherein said portion surrounding the embedded part is integrally formed with said one of said handle body and said connecting portion, and connected through said at least one coupling through-hole, and wherein said part of said other of said handle body and said connecting portion, which is embedded in said one of said handle body and said connecting portion, comprises an anchor-shaped portion, a sectional area of which increases in a direction of embedding of said part of said other of said handle body and said connecting portion in said one of said handle body and said connecting portion.

10. The trunk locking system according to claim 9, wherein the part of said connecting portion which is embedded in said handle body comprises at least one icon-shaped element that is integrally formed with said part of said connecting member, and wherein said handle body is molded with said part of said connecting member with both end faces of said icon-shaped element exposed from a surface of said handle body.

* * * * *